US006517406B1

(12) United States Patent
Cash

(10) Patent No.: US 6,517,406 B1
(45) Date of Patent: Feb. 11, 2003

(54) SPORTS BALL DOLLS

(76) Inventor: Phillip Cash, P.O. Box 1862, Chatsworth, GA (US) 30705

( * ) Notice: Subject to any disclaimer, the term of this patent is extended or adjusted under 35 U.S.C. 154(b) by 0 days.

(21) Appl. No.: 09/886,871

(22) Filed: Jun. 21, 2001

(51) Int. Cl.[7] ..... A63H 3/02; A63H 3/16
(52) U.S. Cl. ..... 446/97; 446/390; 446/901
(58) Field of Search ..... 446/97, 98, 99, 446/100, 101, 369, 901, 385, 390, 381

(56) References Cited

U.S. PATENT DOCUMENTS

| | | | | |
|---|---|---|---|---|
| 4,540,378 | A | | 9/1985 | Cusimano |
| D300,336 | S | | 3/1989 | Colclasure |
| 4,883,441 | A | | 11/1989 | Byer |
| 4,979,924 | A | | 12/1990 | Manger |
| D325,762 | S | | 4/1992 | Hoglund |
| D325,763 | S | | 4/1992 | Hoglund |
| 5,195,917 | A | | 3/1993 | Russell et al. |
| 5,232,390 | A | | 8/1993 | Brooks |
| 5,288,261 | A | | 2/1994 | Spector |
| D349,531 | S | | 8/1994 | McGregor |
| 5,340,348 | A | * | 8/1994 | Schroeder ..... 206/579 |
| 5,348,510 | A | | 9/1994 | DuPont et al. |
| 5,394,565 | A | * | 3/1995 | Stewart et al. ..... 2/108 |
| 5,413,331 | A | | 5/1995 | Stillinger |

FOREIGN PATENT DOCUMENTS

| | | |
|---|---|---|
| CH | 56616 | 9/1975 |

* cited by examiner

*Primary Examiner*—Jacob K. Ackun
(74) *Attorney, Agent, or Firm*—Stephen J. Stark; Miller & Martin LLP

(57) ABSTRACT

A doll having a sports ball body with attachments connected thereto. The attachments are preferably connected with hooks and loops, commonly known as Velcro(™) with cooperating connectors on the ball body. The body connectors are preferably located on a piece of fabric secured to the inside portion of the ball body with a flap of the ball body cut into the ball body exposing an opening with the body connector therein. The underside of the flap is preferably equipped with a cooperating flap connector which cooperates with the body connector when the attachment is not in use so that the flap is substantially continuous with the remainder of the surface of the ball body.

16 Claims, 1 Drawing Sheet

SPORTS BALL DOLLS

BACKGROUND OF THE INVENTION

The present invention relates to dolls including a portion configured to resemble a sports ball such as a football, soccer ball, baseball, basketball or any other sport playing piece, and more particularly to a doll having a sports ball body having removable accessories such as arms and legs which may be removed so that a user can play with the ball and later reattach the accessories to form the doll.

PRIOR ART

A number of sports doll products have been developed. Specifically, U.S. Pat. No. 4,883,441 shows a sports ball having a baseball head, baseball bat arms, football legs and a basketball body. The body parts are connected with Velcro(™). U.S. Pat. No. 5,195,917 also shows a doll with Velcro(™) attached appendages entitled Tear-Apart Stress Relief Doll and Method. These designs show that removable attachments to sports related dolls are known in the art. However, when the arms, legs and head of Byer, U.S. Pat. No. 4,883,441 are removed, connectors in the form of loops or hooks remain exposed which may interfere with the play of the ball or may become worn to the point of being unable to serve as a connector after continued use.

Accordingly, a need exists to protect the connectors in a sports doll product so that the sport ball may be utilized for a number of years without significant deterioration of the connectors due to the ball's use as a ball.

SUMMARY OF THE INVENTION

The present invention relates to dolls which are comprised of a ball, or other simple playing piece which is connected to attachments to form a doll.

The ball portion of the doll is equipped with connector portions which have cooperating protective flaps which cooperate with the connector portions when the attachments are removed so that the connector portions are protected during play with the ball.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
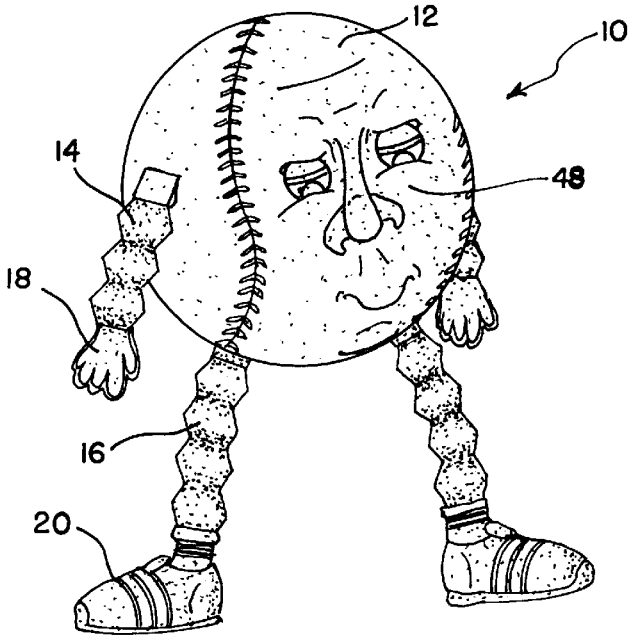
FIG. 1 is a side perspective view of a doll of the preferred embodiment.

Referring to the figures, FIG. 1 shows a sports doll 10 having a ball body 12. Attached to the body 12 are attachments 14, 16 in the form of arms and legs. The arm attachments 14 have hands 18 and the leg attachments 16 have shoes 20. The attachments 14, 16 are designed to be removable from the ball body 12. Although only arms and legs are illustrated as attachments 14, 16, other attachments including hats or helmets, other body portions, etc., could also be utilized as attachments. Furthermore, the ball body 12 could be the head, torso, or other part of the doll 10.

Figure 2:
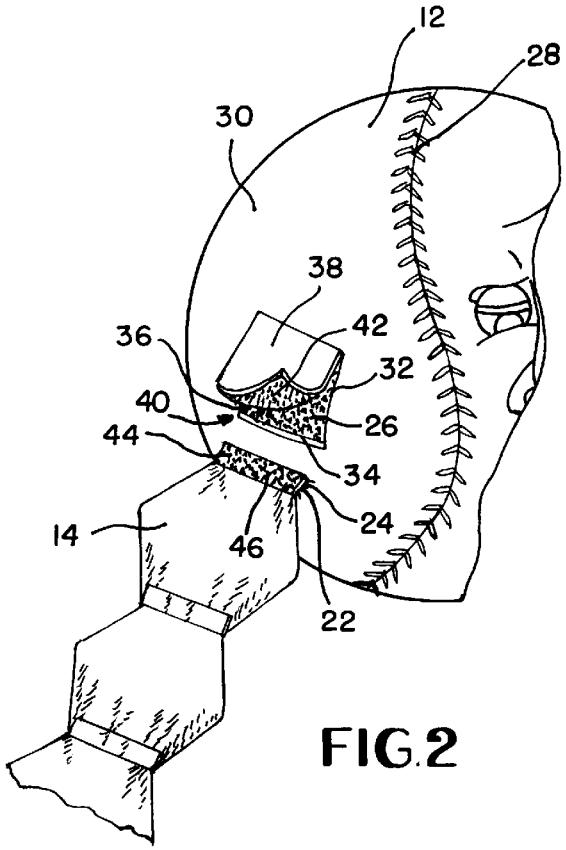
FIG. 2 is a close-up view of the connections of an appendage with the ball portion of the doll.

A detail of the connection of the attachment of attachment arm 14 to the body 12 is shown in FIG. 2. Specifically, the attachment 14 has at least one surface 22 equipped with a connector 24. The connector 24 is illustrated as the hooked portion of a common connector known as Velcro(™). The hooks cooperate with loops 26 which have been installed as shown in FIG. 2.

In FIG. 2, the ball body 12 has been stitched together along the seam 28. The first piece 30 is illustrate with three cuts 32, 34, 36 made in the first portion 30 to create flap 38 with the flap 38 cut in the first portion 30, an opening 40 is created in the first portion 30. Within the opening 40, preferably on the interior side of the first portion 30, a strip of fabric with the loops 26 is connected to the first portion 30 to act as a body connector.

Figure 3:
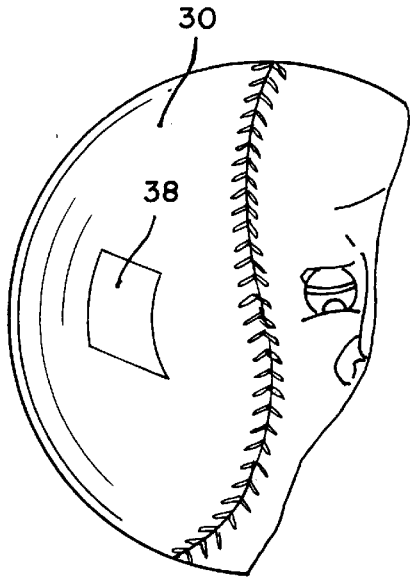
FIG. 3 is a close-up view of the protective flap covering the connection portion illustrated in FIG. 2.

The flap 38 is illustrated having a piece of fabric with hooks 42 sewn, glued or otherwise connected to the flap 38 on the underside of the flap 38 so that when the flap 38 is shut, as illustrated in FIG. 3, the hooks 42 cooperate with loops 26 to secure the flap 38 shut relative to the first portion 30 to preferably provide a substantially continuous outer surface of the ball body 12. Accordingly, a child or other user may play with the ball without interference of the connectors 26 which extend from the known prior art devices in an unprotected manner. Of course, connectors other than hooks 42 and loops 26 may be utilized on either of the flap 38 and/or first portion 30.

Referring back to FIG. 2, when the arm attachment 14 is to be attached and detached as shown in FIG. 2, the hooks 24 on the attachment 14 are placed in contact with the loops 26. Of course, other appropriate connectors may be utilized as well. It is further anticipated that loops 44 will be installed opposite to hooks 24 so that they may cooperate with the hooks 42 on the underside of flap 38 to further secure the attachment 14, 16 to the ball body 12. This similar connection system is preferred for the four attachments 14, 16 illustrated in FIG. 1.

Although a baseball body is illustrated with face 48, other designs could be utilized. Specifically, basketballs, footballs, soccer balls, hockey pucks, frisbees, golf balls, tennis balls, etc., could be utilized for the ball body 12. The face 48 may be stitched, or otherwise designed in/or connected to the ball body 12. The ball body 12 itself is preferably constructed of a vinyl or leatherlike fabric resembling the particular sporting product, i.e., white for baseballs/softballs, brown for basketballs and footballs, and white and black for soccer balls. Of course, other colors and fabrics could be utilized as desired. Furthermore, the ball body 12 is stuffed with an appropriate substance to provide the desired squeezability of the toy product. The ball body 12 may bounce or may resist bouncing depending on the particular design characteristics utilized during fabrication.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A doll comprising:

a ball body;

attachments removably connected to the ball body at first connectors on the ball body, said attachments having opposing second and third connectors at an end of the attachments; and flaps connected to the ball body covering the connectors when the attachments are not connected to the ball body, said flaps having fourth connectors on an underside of the flaps which cooperates with the first connectors connecting the flaps to the ball body when the attachments are not connected to the ball body, said flaps moveable to expose the first connectors for connecting the attachments to the ball body with the second connectors connected to the first connectors and the fourth connectors connected to the flaps, said flaps resembling a portion of the ball body.

2. The doll of claim 1 wherein the ball body is configured in the shape of a baseball.

3. The doll of claim 1 wherein the ball body is configured in the shape of a softball.

4. The doll of claim 1 wherein the ball body further comprises a face.

5. The doll of claim 4 wherein the face is stitched in the ball body.

6. The doll of claim 1 wherein the first connectors are comprised of one of loops and hooks.

7. The doll of claim 1 wherein the flaps are cut out of a first portion of a surface of the ball body to expose an opening.

8. The doll of claim 7 wherein the first connectors are connected to the first portion within the opening.

9. The doll of claim 8 wherein the first connectors are contained on a fabric piece, said fabric piece connected to the interior of the first portion within the opening.

10. The doll of claim 1 wherein the outer surfaces of one of the flaps is substantially continuous with the outer surface of the first portion of the ball body when the selected attachment is removed from the ball body and the one of the flaps is connected by the flap connector to the connector on the ball body.

11. The doll of claim 1 wherein the attachments are comprised of arms and legs.

12. A doll comprising:

a ball body having a face thereon;

attachments removably connected to the ball body at body connectors on the ball body; and flaps on the ball body covering the body connectors when the attachments are not connected to the ball body, said flaps moveable to expose the body connectors for connecting the attachments to the ball body, said flaps resembling a portion of the ball body when covering the body connectors, said flaps each having a flap connector on an underside of the flap which cooperates with one of the body connectors when covering the body connectors, said attachments having opposing first and second connectors, wherein when one of the attachments is connected to the ball body, the first connector connects to the ball connector and the second connector connects to the flap connector.

13. The doll of claim 12 wherein the face is stitched into the ball body.

14. The doll of claim 12 wherein the body connectors are located in an opening in a first portion of the ball body.

15. The doll of claim 14 wherein an outer surface of one of the flaps is substantially continuous with the first portion of the ball body when the respective flap connector from the one of the flaps is connected with the respective body connector.

16. The doll of claim 12 wherein the attachments comprise at least one of arms and legs.

* * * * *